US007762904B2

(12) United States Patent
McManus et al.

(10) Patent No.: US 7,762,904 B2
(45) Date of Patent: Jul. 27, 2010

(54) GOLF SWING TRAINING DEVICE

(76) Inventors: Matthew T. McManus, 541 Clemray Dr., Cincinnati, OH (US) 45231; Christopher H. Pfaltzgraff, 10285 Kerrianna Dr., Cincinnati, OH (US) 45242

( * ) Notice: Subject to any disclaimer, the term of this patent is extended or adjusted under 35 U.S.C. 154(b) by 7 days.

(21) Appl. No.: 12/401,299

(22) Filed: Mar. 10, 2009

(65) Prior Publication Data

US 2009/0247311 A1 Oct. 1, 2009

Related U.S. Application Data

(60) Provisional application No. 61/072,309, filed on Mar. 31, 2008.

(51) Int. Cl.
*A63B 69/36* (2006.01)

(52) U.S. Cl. ..... 473/215; 473/207; 473/216; 473/277

(58) Field of Classification Search ..... 473/207, 473/215, 216, 257, 266, 277
See application file for complete search history.

(56) References Cited

U.S. PATENT DOCUMENTS 1,530,519 A * 3/1925 Remington ..... 473/216
2,690,911 A * 10/1954 Newgren ..... 473/271
3,698,721 A * 10/1972 Stewart ..... 473/264
6,120,418 A * 9/2000 Plough ..... 482/69

* cited by examiner

*Primary Examiner*—Nini Legesse
(74) *Attorney, Agent, or Firm*—Wood, Herron & Evans, LLP

(57) ABSTRACT

A golf swing training device comprising a base adapted for support by the ground and a vertical pole connected to and extending vertically from the base to accommodate the height of a golfer. A reminder seat is connected to the vertical pole to accommodate the golfer's posterior resting against the seat during a golf swing and facing away from the vertical pole. An elastic band is secured to the vertical pole at a distance above the reminder seat forming a loop around the golfer's chest. The elastic band enables the golfer's abdominal and core muscles to keep flexion throughout the golf swing, thereby allowing a free swinging motion of the golfer while limiting lateral and vertical movement of the body.

10 Claims, 3 Drawing Sheets

GOLF SWING TRAINING DEVICE

RELATED APPLICATION

This application is a nonprovisional application claiming the benefit of provisional application U.S. Ser. No. 61/072,309 filed Mar. 31, 2008, the entirety of which is incorporated herein by reference.

FIELD OF THE INVENTION

The present invention relates to golf swing training devices in general and, in particular, an instructional teaching aid for improving a golf swing, which enables a golfer, with minimal instruction, to practice and develop a proper swing.

BACKGROUND OF THE INVENTION

Many devices have been proposed for aiding a golfer in developing a proper golf swing. Devices have been proposed which attempt to teach a proper golf swing even without swinging an actual golf club. Other devices rely on developing muscle memory, whereby it is intended that the golfer learns to produce a correct golf swing without the aid of such a device. With the advance of educational technology, video, and computerized methods, a number of sophisticated devices have been proposed. However, many of these devices are subject to a number of shortcomings. They especially do not allow golfers to make a free swinging motion with a golf club while striking the golf ball, thereby enabling a golfer to develop a proper golf club swing.

SUMMARY OF THE INVENTION

It is an objective of this invention to provide a relatively simple device to allow golfers to make a free swinging motion with a golf club while striking the golf ball, yet limiting lateral and vertical movement of the body.

It is also an objective of this invention to provide a golfer with a device for training the core muscles used during a golf club swinging motion. Another objective is to provide a universal device which is usable by women or men without limitation as to their heights or bodily makeup.

The golf swing training device of this invention comprises a base adapted for support by the ground and a vertical pole connected to and extending vertically from the base to accommodate the height of a golfer. A reminder seat is connected to the vertical pole to accommodate the posterior of the golfer resting against the seat and facing away from the vertical pole. An elastic band is secured to the vertical pole at a distance above the reminder seat and behind the golfer. The elastic band is sized to fit around the golfer's chest and under his arms facing away from the vertical pole. With the elastic strap, as explained hereinafter, essentially one size would fit all golfers using the device. As the golfer addresses the ball, he leans forward from the hips with his spine at an angle to the ball. The elastic band stretches and, because of its elasticity, is forms an elastic loop which places pressure on the chest with the abdominal and core muscles in flexion. The elastic band enables the golfer's abdominal and core muscles to keep flexion throughout the golf swing, thereby allowing a free swinging motion of the golfer while limiting lateral and vertical movement. The reminder seat helps to keep the golfer in his stance throughout his full swing until after he strikes the ball.

DETAILED DESCRIPTION OF THE PREFERRED EMBODIMENTS OF THE INVENTION WITH REFERENCE TO THE DRAWINGS

Figure 1:
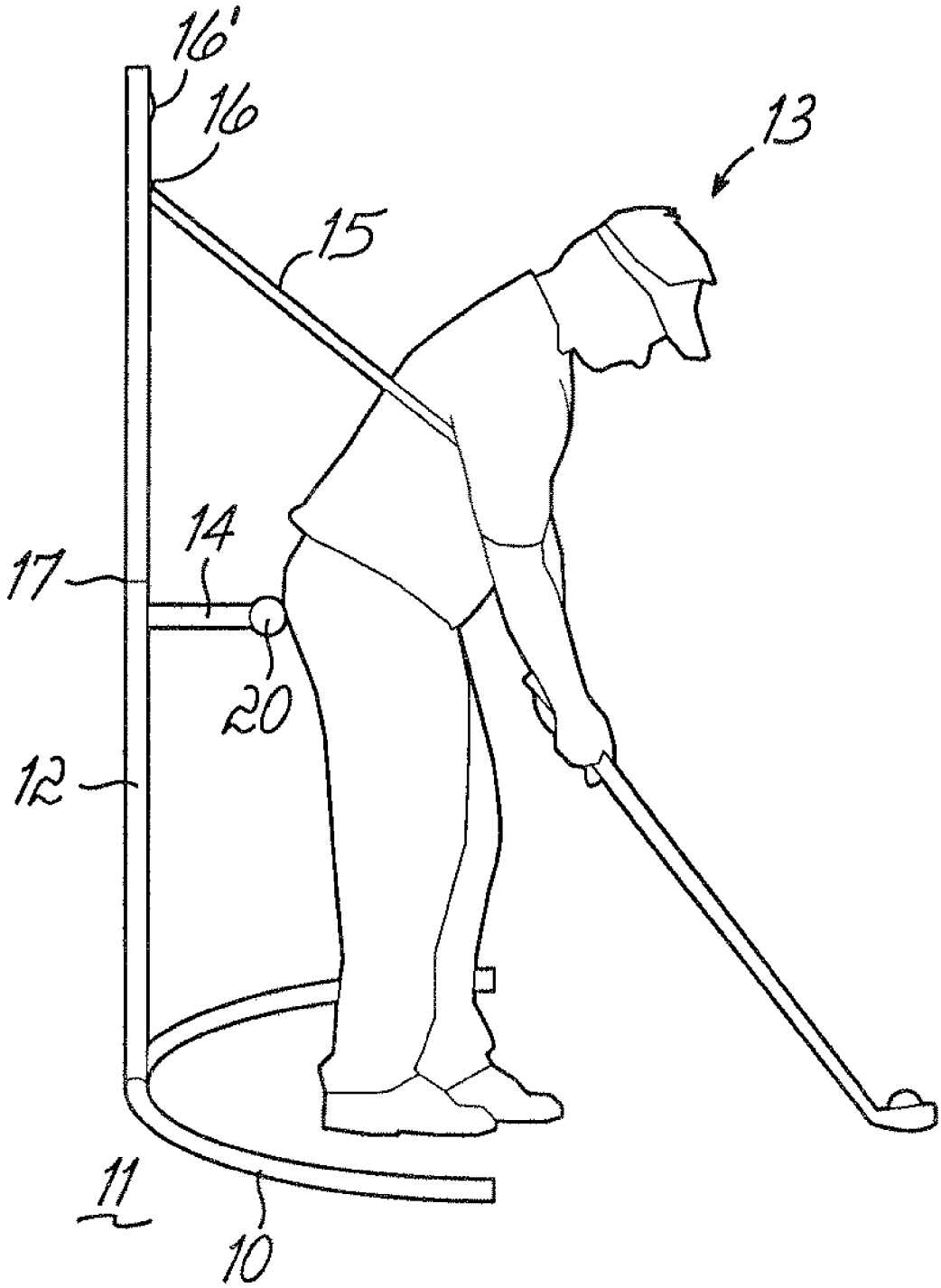
FIG. 1 is a side view of a golfer with a golf club in an address position for using the training device in accordance with the invention.

The golf swing training device of FIG. 1 comprises a base 10 supported by the ground 11 and a vertical pole 12 connected to and extending vertically from the base 10 to accommodate the height of a golfer 13. A reminder seat 14 is connected to the vertical pole 12 to accommodate the golfer's posterior resting against the seat 14 with the golfer 13 facing away from the vertical pole 12. An elastic circular band 15 is secured to the vertical pole 12 by suitable connectors 16 at a distance above the reminder seat 14 and secured behind the golfer 13. FIG. 3A illustrates in an enlarged view the band 15 threaded through the circular connectors 16 mounted on pole 12. Other connectors 16', like 16, can be used for connecting the elastic band 15 to the vertical pole 12. The elastic band 15 is in the form of a loop around the golfer's chest and under his arms. Essentially, one size of the elastic band fits all golfers using the device. The elastic band 15 enables the golfer's abdominal and core muscles to keep flexion throughout the golf swing, thereby allow a free swinging motion of the golfer while limiting lateral and vertical movement.

Figure 2C:
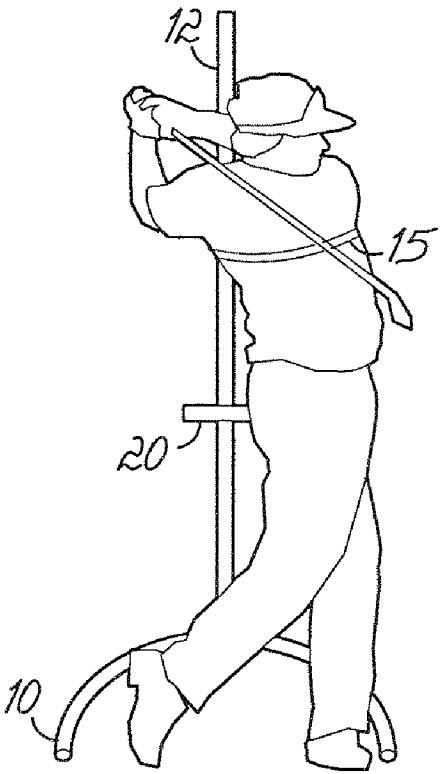
FIGS. 2A, 2B, and 2C are front views of a golfer addressing the ball, a full backswing position of the golf stroke, and a full follow through portion of the stroke, respectively, all while using the golf swing training device of the invention.
Figure 2B:
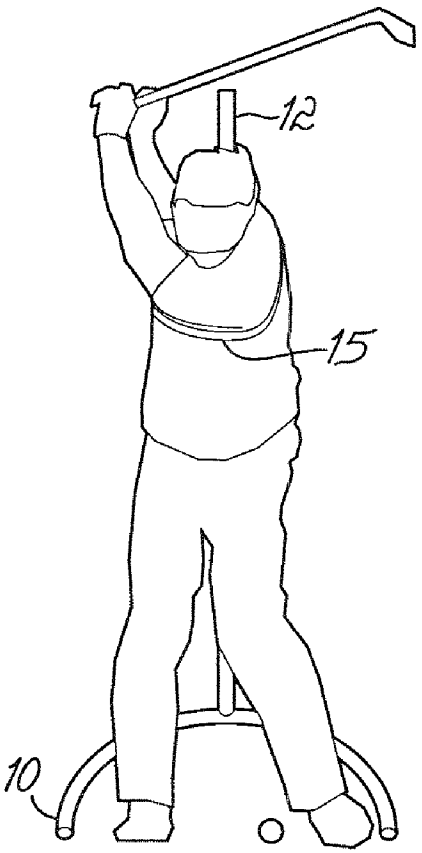
Figure 2A:
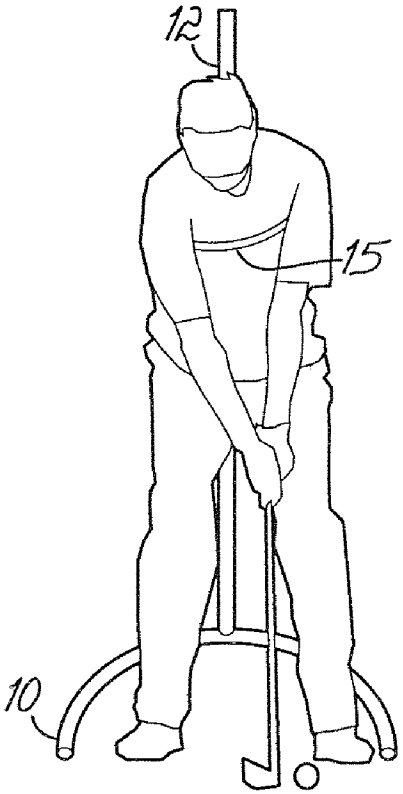
Figure 3:
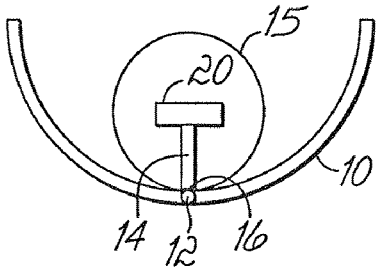
FIG. 3 is a vertical view from the top of the device.
Figure 3A:
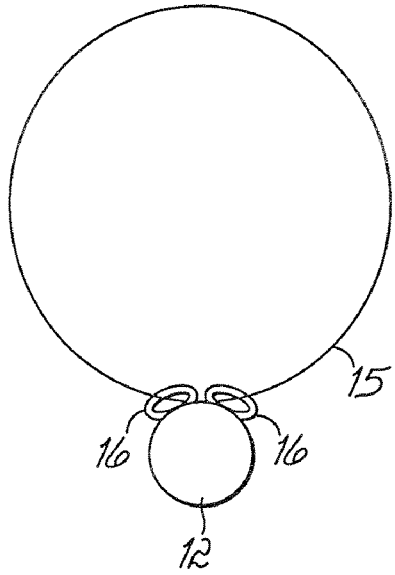
FIG. 3A is an enlarged view of the connectors that fasten the band to the pole.
Figure 4A:
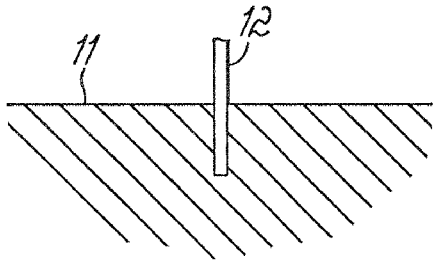
FIGS. 4A, 4B, and 4C are diagrammatic illustrations of different device bases for support by the ground.
Figure 4B:
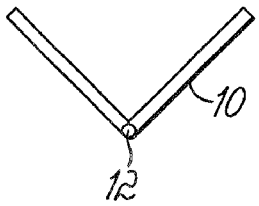
Figure 4C:
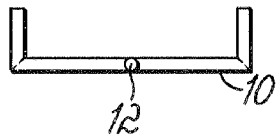

As shown in FIGS. 1-4, the base 10 can consist of different sizes or shapes of tubular elements, for example triangular, square, or U-shaped as illustrated by FIGS. 4A-4C. The vertical pole 12 can be embedded in the ground for support and stability as shown by Fig. A. Preferably, it has been found that a U-shaped base 10 of FIGS. 1-3 provides the necessary stability and minimizes any interference that a golfer may encounter while using the device. The base can be any width, but ideally will be between 36-48 inches. The vertical pole 12 will extend out of the base 10 at any point. However, it has been found that the best place for this will be the immediate back left for a right-handed golfer, and the immediate back right for a left-handed golfer.

A vertical pole 12 can be any height, but ideally it will be between about 36-48 inches tall in order to accommodate any height of golfer. A preferred form of the vertical pole 12 is telescoping from a position, for example, at 17 of FIG. 1 to accommodate different heights of golfers. The pole may be fabricated of any strong material, such as steel, to accommodate the use of the device, and, when telescoping, the telescoping member at 17 will fit tightly in the vertical pole, thereby enabling the pole to be telescoped to any height of 36 inches or more.

The elastic band 15 is made of rubber, for example, that is durable, stretchable and recoverable to provide the necessary pressure on the body chest and core muscles to keep them in flexion throughout the swing. A suitable rubber elastic band has a length of about 41" and a width of ½" and provides resistance, for example, up to about 35 lbs., depending upon thickness. Such bands are available in commerce, for example from JumpStretch, Inc.

As shown in FIG. 3, the reminder seat 14 is connected to the vertical pole 12, and essentially consists of a pole 20 horizontal to the ground that may be adjustable to any height along the vertical pole to accommodate the posterior rest of any size golfer. The pole 20 extending horizontally to the ground is attached to the vertical pole 12 in any fashion, for example, in a T-shape as shown in FIG. 3. By making posterior contact with the seat 14, a golfer is reminded to stay in the swing and not to come out of it by moving laterally or vertically. The elastic circular band 15 is secured by threading through connectors 16 as shown in FIG. 3A to the vertical pole 12, and has a primary purpose of helping to reduce any excess upper body movement in the golf swing. The elastic band 15 will come over the head of the golfer 13 and be placed under his arms, thus strapping him in. For a female golfer, the band will ideally be strapped in above the breasts and under the arms as well.

At the address position in FIG. 1, the golfer 13 is facing away from the swing device, with his or her posterior resting against the horizontal pole 20, and having the band 15 come over the head and under the arms to allow for full range of motion to perform an ideal golf swing while limiting unnecessary body movement. The flexible or elastic band 15 will enable the device to universally fit golfers without adjustment. During a golf swing, with the elastic strap around the golfer's chest, the abdominal and other core muscles are in flexion. With the elastic band 15, a golfer 13 who tends to stand up during the downswing will still have pressure upon his chest, causing his core muscles to keep flexion throughout the downswing, and in turn making it almost impossible to make the dreaded pelvic thrust. The elastic band 15 thus makes muscle memory possible by keeping pressure on the abdominal and core muscles. The key function of the elastic band 15 is to keep constant pressure on the golfer's chest, with slight restriction to keep core muscles engaged throughout the golf swing.

In use, as shown in FIGS. 1, 2A, 2B, and 2C, during the golf swing, at address the golfer 13 leans forward from the hips, angling his spine toward the ball, having his posterior resting against the seat 14. As the elastic band 15 stretches, the golfer 13 engages his core muscles and feels the pressure upon his chest. When the golfer takes the club 19 back to a full backswing, as shown in FIG. 3B, pressure will be maintained on the chest, causing the core muscles to keep flexion. The golfer's posterior maintains contact with the seat 14, particularly pole 20. As the golfer initiates the downswing to the full end swing of FIG. 3C, the elastic band 15 keeps pressure on the muscles providing muscle memory to enable the golfer 13, with slight restriction, to keep the core muscles engaged throughout the golf swing, as shown in FIGS. 3A to 3C. The golf training device thus allows for a free swinging motion during ball striking while limiting lateral and vertical movement of the body. When playing without the device, the golfer's muscle memory is activated to achieve the results promoted by the device, namely, a controlled stable golf swing.

In view of the above description, other variations of the inventive golf swing trainer will be apparent without departing from the scope of this invention.

What is claimed is:

1. A golf swing training device comprising a base adapted for support by the ground, a vertical pole connected to and extending vertically from the base to accommodate the height of a golfer, a reminder seat connected to the vertical pole to accommodate the golfer's posterior resting against the seat during a golf swing and facing away from the vertical pole, an elastic band secured to the vertical pole at a distance above the reminder seat and secured behind the golfer, the elastic band forming an elastic loop around the golfer's chest facing away from the vertical pole, said elastic band enabling the golfer's abdominal and core muscles to keep flexion throughout the golf swing, thereby allowing a free swinging motion of the golfer while limiting lateral and vertical movement of the body.

2. The device of claim 1 wherein the base has a generally triangular, square, or U-shaped form to provide stability and minimize interference during use of the device.

3. The device of claim 1 wherein the vertical pole is telescoping to accommodate the height of different golfers.

4. The device of claim 1 wherein the vertical pole has a plurality of connectors along its length to accommodate the elastic band being secured to it at different heights.

5. The device of claim 1 wherein the vertical pole is embedded in the ground.

6. The device of claim 1 wherein the reminder seat is a pole extending horizontally to the ground and connected to the vertical pole.

7. The device of claim 6, wherein the seat is adjustable along the length of the pole.

8. A golf swing training device comprising a base adapted for support by the ground, a telescoping vertical pole connected to and extending vertically from the base to accommodate the height of a golfer, an adjustable reminder seat connected to the vertical pole to accommodate the golfer's posterior resting against the seat during a golf swing and facing away from the vertical pole, an elastic band secured to the vertical pole at a distance above the reminder seat and secured behind the golfer, the elastic band forming an elastic loop around the golfer's chest facing away from the vertical pole, said elastic band enabling the golfer's abdominal and core muscles to keep flexion throughout the golf swing, thereby allowing a free swinging motion of the golfer while limiting lateral and vertical movement.

9. The device of claim 8 wherein the base is generally U-shaped.

10. The device of claim 8 wherein the vertical pole is embedded in the ground.

* * * * *